United States Patent [19]

Calvert

[11] 4,007,830

[45] Feb. 15, 1977

[54] ARTICLE CARRIER PARTITION INSERT

[75] Inventor: Rodney K. Calvert, Dunwoody, Ga.

[73] Assignee: The Mead Corporation, Dayton, Ohio

[22] Filed: Nov. 17, 1975

[21] Appl. No.: 632,226

[52] U.S. Cl. ..... 206/175; 229/28 BC; 229/29 E; 217/18

[51] Int. Cl.[2] ..... B65D 75/52

[58] Field of Search ..... 206/174–179; 229/15, 27–29; 217/18, 23

[56] References Cited

UNITED STATES PATENTS

| | | | |
|---|---|---|---|
| 2,545,589 | 3/1951 | Sausing | 229/28 BC |
| 2,709,535 | 5/1955 | Bergstein | 229/28 BC |
| 3,070,276 | 12/1962 | Richardson | 229/28 BC |
| 3,904,036 | 9/1975 | Forrer | 206/427 |

FOREIGN PATENTS OR APPLICATIONS

| | | | |
|---|---|---|---|
| 599,204 | 5/1960 | Canada | 229/15 |

*Primary Examiner*—George E. Lowrance
*Assistant Examiner*—Douglas B. Farrow
*Attorney, Agent, or Firm*—Walter M. Rodgers; Walter A. Rodgers

[57] ABSTRACT

An article carrier for use in conjunction with fragile articles arranged in at least two rows of at least two articles each is provided with a partition insert structure arranged to afford double thickness separation between adjacent articles and includes a pair of vertically disposed main panels arranged in back to back disposition together with a horizontally disposed spacer panel foldably joined along its side edges of the bottom edges of the main panels by serpentine fold lines to establish pockets adjacent the articles for affording cushioning action. At least one partition strip may be interconnected with one of the main panels at one end thereof and to a partition panel at the other end thereof. A pair of inserts may be arranged within the enclosed structure in such manner that the partition panels of both inserts are disposed in flat face contacting relation to each other so as to obtain a double thickness separator between the rows of adjacent articles, double thickness between articles in each row also being provided by cross partition tabs doubled back on themselves.

21 Claims, 10 Drawing Figures

ARTICLE CARRIER PARTITION INSERT

U.S. Pat. No. 3,904,036 granted Sept. 9, 1975, discloses and claims a totally enclosed bottle carrier which is specially constructed so as snugly to engage and firmly to position a plurality of fragile articles such as bottles having tapered neck portions and in this manner to minimize the likelihood of bottle breakage.

While not so limited, this invention is especially adapted to provide a double thickness partition structure which is well suited for use in conjunction with the totally enclosed container of U.S. Pat. No. 3,904,036. While a single partition insert constructed according to this invention may be used in conjunction with a container constructed in accordance with the aforementioned patent, certain advantages such as economy in the use of material and efficiency in packaging a number of articles such as twelve or more may be achieved by using a pair of inserts formed according to this invention and inserted into the container with associated groups of articles from opposite ends thereof. In this manner a partition structure is provided for two groups of articles which when inserted into the totally enclosed container are separated from each other by a double thickness of material, one thickness of which is provided by one insert and the other thickness of which is provided by a corresponding face contacting panel of the other insert.

According to this invention, a carrier partition insert is provided for cushioning articles arranged in two rows of at least two articles each, the insert comprising a pair of vertically disposed main panels arranged for back to back disposition between the rows of articles and a horizontally disposed spacer panel foldably joined along its side edges to the bottom edges of the main panels to establish a spaced relation therebetween which is generally serpentine in nature and which provides cushioning pockets along the exposed surfaces of each of the main panels. In order to adapt an insert formed according to this invention for use in pairs, it is desirable to provide a cushioning panel interconnected with one of the main panels by at least one transverse partition strip and to interrelate the cushioning panel with the cushioning strip in such manner as to insure precise and secure positioning of the insert structure within the container and relative to the articles which are separated by the partition structure. Partition tabs are struck from the main panel and doubled back on themselves so as to afford double thickness separation between the articles in one row, double thickness between the articles in one row and the articles in the other row being provided by the two main back to back panels.

Figure 1:
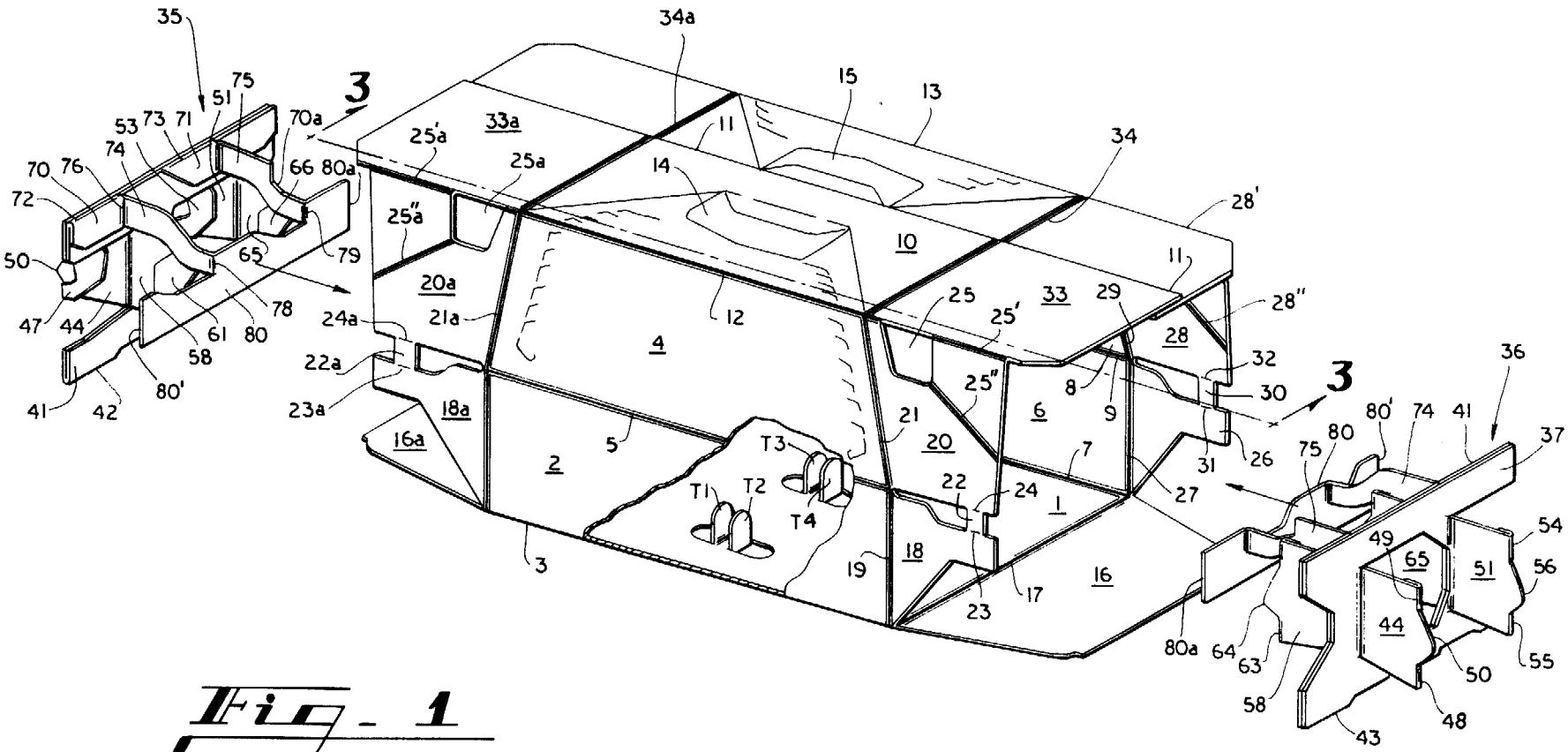
Figure 2:
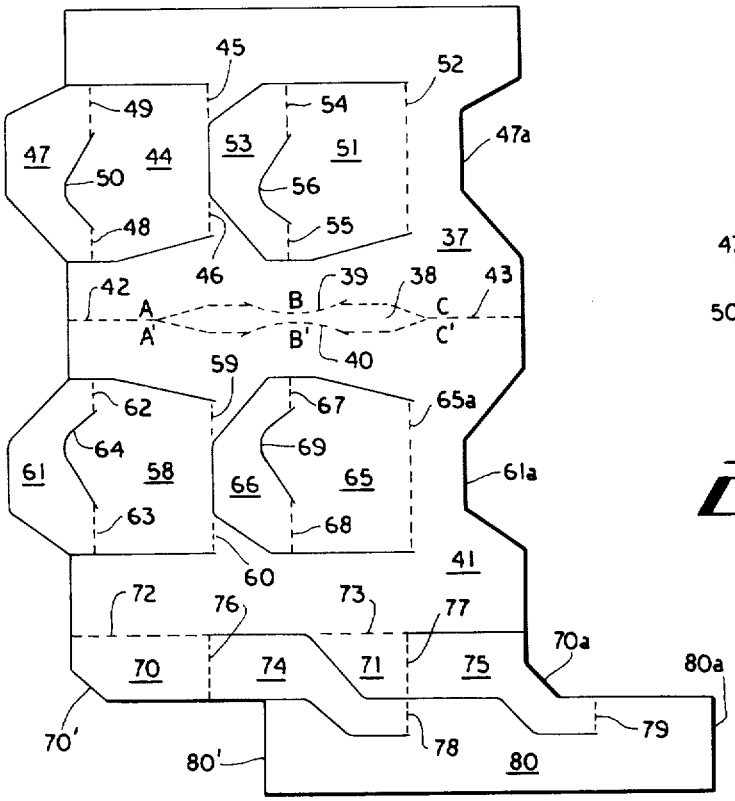
Figure 3:
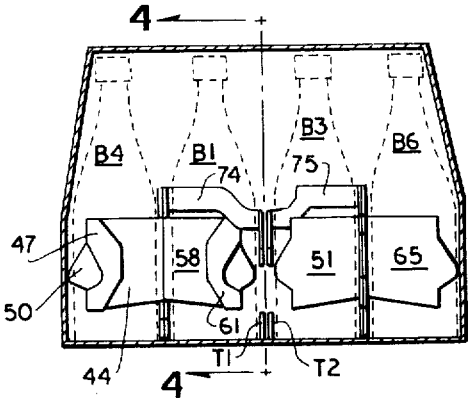
Figure 4:
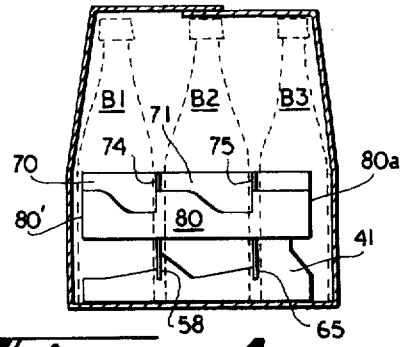
Figure 5:
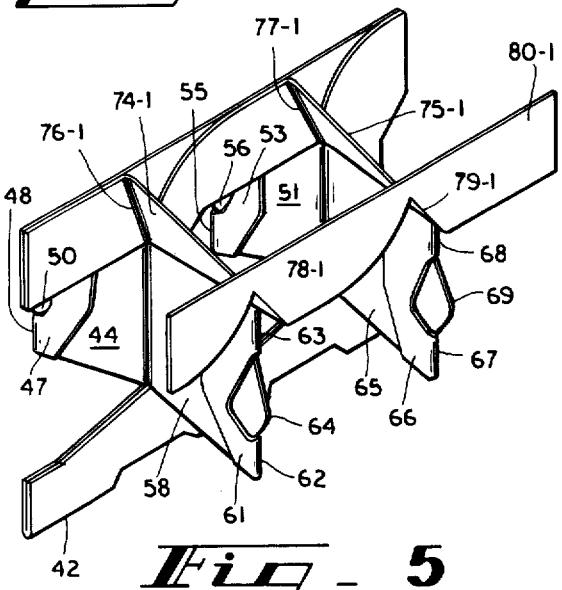
Figure 6:
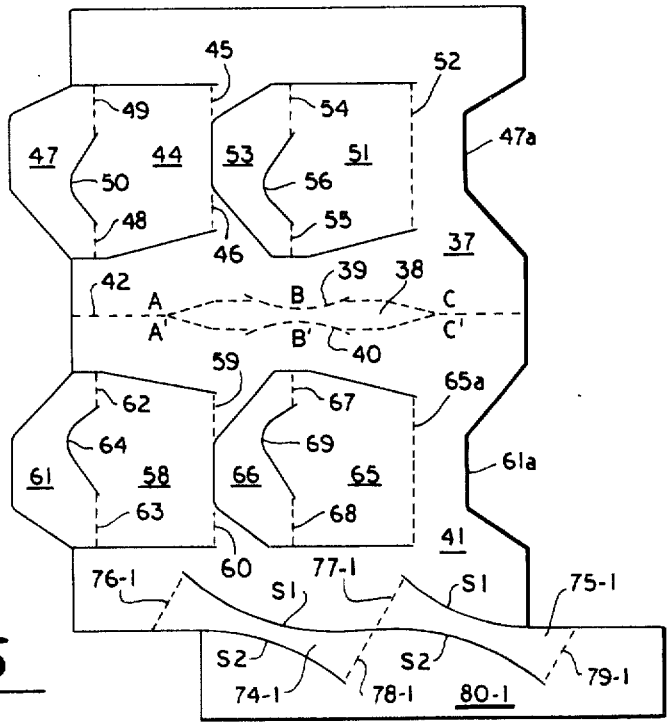
Figure 7:
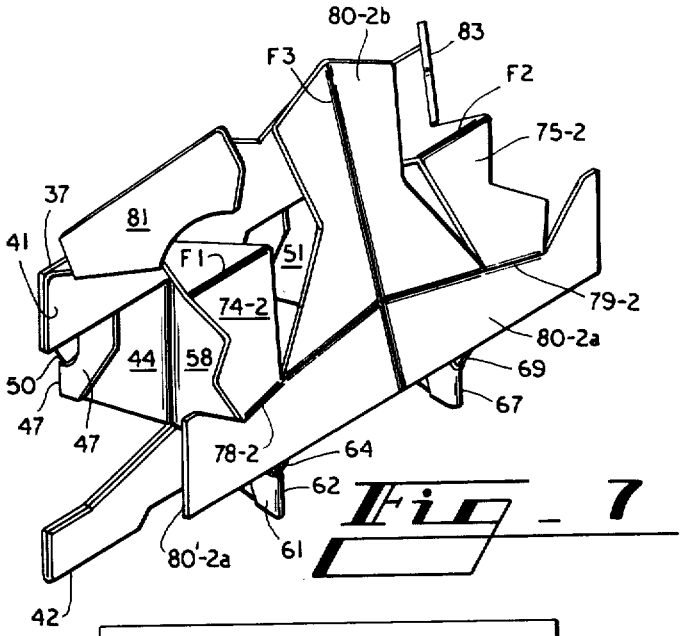
Figure 9:
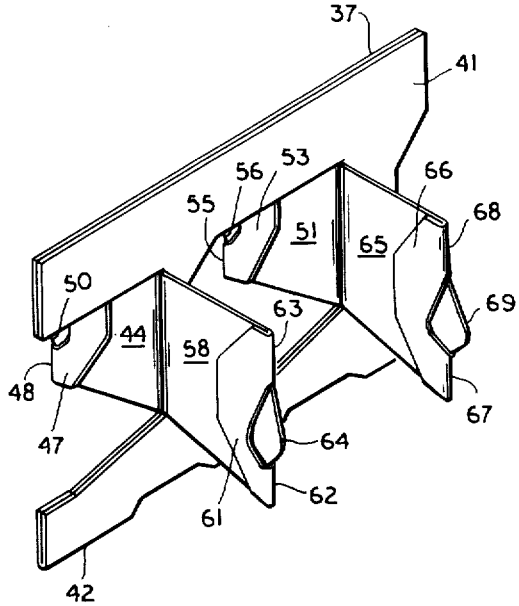
Figure 8:
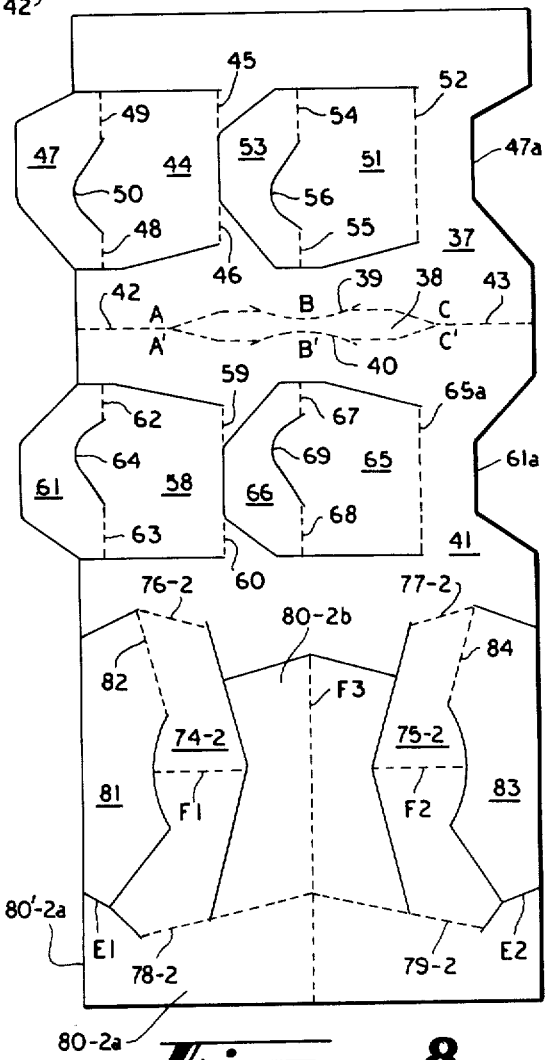
Figure 10:
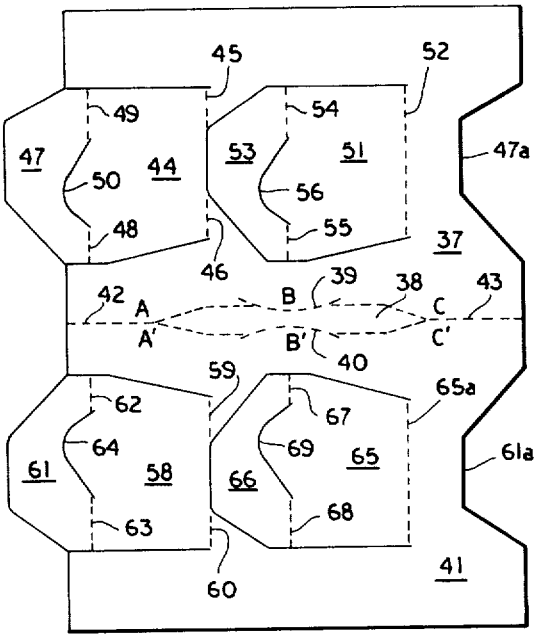

For a better understanding of the invention, reference may be had to the following detailed description taken in conjunction with the accompanying drawings in which FIG. 1 is a perspective exploded view of an open ended sleeve type container together with a pair of inserts constructed according to this invention and which are adapted for insertion with their associated articles through opposite ends of the open ended container; FIG. 2 is a plan view of a blank used in forming the two partition inserts shown in FIG. 1; FIG. 3 is a cross sectional view taken along the line designated 3—3 in FIG. 1; FIG. 4 is a cross sectional view taken along the line designated 4—4 in FIG. 3; FIG. 5 is a perspective view of a set-up insert constructed according to a modification of the arrangement shown for example in FIGS. 1 and 2; FIG. 6 is a plan view of a blank used in forming the insert shown in FIG. 5; FIG. 7 is a perspective view of a set-up insert formed according to another modification of the invention; FIG. 8 is a plan view of a blank used in forming the insert shown in FIG. 7; FIG. 9 is a perspective view of a basic insert structure used in all modifications of the invention; and in which FIG. 10 is a plan view of a blank used in forming the insert shown in FIG. 9.

In FIG. 1 the open ended sleeve type carton shown in that figure comprises a bottom panel 1, a lower side wall panel 2 which is foldably joined to the side edge of bottom panel 1 along fold line 3 together with a sloping upper side wall panel 4 which is foldably joined to the lower side wall panel 2 along fold line 5. The other side of the carrier is similar in that a lower side wall panel 6 is foldably joined along fold line 7 to a side edge of bottom panel 1 and a sloping upper side wall portion 8 is foldably joined to lower side wall portion 6 along fold line 9. Top wall panel 10 is a composite panel and is overlapped at its mid-portion 11. Top panel 10 is foldably joined along fold line 12 to panel 4 and along fold line 13 to panel 8. A pair of hand gripping apertures 14 and 15 are formed in known manner in top panel 10.

The end flaps at the ends of the carton are identical and the flaps at only one end will be described, the flaps at the other end having the same numerals with the subscript "a" added. For example, bottom end panel 16 is foldably joined along fold line 17 to an end edge of bottom panel 1. Lower end flap 18 is foldably joined to panel 2 along fold line 19 while upper end flap 20 is foldably joined to panel 4 along fold line 21. Web panel 22 is foldably joined to panel 18 along fold line 23 and to panel 20 along fold line 24. Panel 20 is provided with an aperture 25 for receiving a part of the cap of the adjacent article such as a bottle and includes a diagonal fold line 25''.

On the opposite side of the carton, lower end flap 26 is foldably joined to side wall 6 along fold line 27 while upper end flap 28 is foldably joined to panel 8 along fold line 29 and includes diagonal fold line 28''. Web panel 30 is foldably joined to lower end flap 26 along fold line 31 and to upper end flap 28 along fold line 32. Upper end panel 33 is a composite panel and is foldably joined to top wall 10 along fold line 34 and to panels 20 and 28 along fold line 25' and 28' respectively.

As is apparent from FIG. 1 a pair of inserts designated generally by the numerals 35 and 36 are arranged for insertion through opposite ends of the open ended sleeve shown in FIG. 1. Inserts 35 and 36 are of identical construction although they are oppositely oriented and adjacent panels of the inserts are disposed in flat face contacting relation so as to afford a double thickness of material between articles disposed in one insert and the adjacent articles disposed in the other insert.

Inserts 35 and 36 are formed from the blank shown in FIG. 2 which comprises a main panel 37 which is interconnected along its bottom edge with a spacer panel 38 having serpentine side edges 39 and 40. Main panel 41 is interconnected with spacer panel 38 along serpentine fold line 40 and with main panel 37 along fold lines 42 and 43.

Partition tab 44 is struck from main panel 37 and is foldably joined thereto along separated fold lines 45 and 46. An end tab 47 is foldably joined to partition tab 44 along separated fold lines 48 and 49 and by a slit 50. Similarly partition tab 51 is struck from main panel 37 and is foldably joined thereto along fold line 52. End tab 53 is foldably joined to partition tab 51 along spaced fold lines 54 and 55 and is separated therefrom by slit 56. A slit 57 separates the outer end of end tab 53 from the base portion of partition tab 44.

Partition tab 58 is similar to partition tab 44 and is struck from main panel 41. Partition tab 58 is foldably joined to main panel 41 along spaced fold lines 59 and 60 and includes an end tab 61 foldably joined to partition tab 58 along coincidental separated fold lines 62 and 63 and is separated from partition tab 58 by slit 64. Partition tab 65 is also struck from main panel 41 and foldably joined thereto along fold line 65a. End tab 66 is foldably joined to partition tab 65 along coincidental fold lines 67 and 68 and is separated therefrom by slit 69.

a pair of anchoring tabs 70 and 71 are foldably joined to the top edge of main panel 41 along fold lines 72 and 73 respectively and are foldably joined to partition strips 74 and 75 along vertical fold lines 76 and 77 respectively. Partition strips 74 and 75 are foldably joined at their opposite ends along fold lines 78 and 79 respectively with partition panel 80.

In order to manipulate the blank of FIG. 2 into the condition represented by the perspective set-up insert 35, it is simply necessary to elevate main panel 41, partition panel 80 and all the parts interconnected therebetween upwardly along fold lines 42 and 43 and serpentine fold lines 39 and 40 to cause main panel 41 to assume a position of flat face contacting relation with main panel 37. This manipulative step causes the main panels 37 and 41 to become vertically disposed and causes spacer panel 38 to become horizontally disposed. Thereafter partition panel 80, partition strips 74 and 75 together with anchoring tabs 70 and 71 are folded forwardly and downwardly to cause the anchoring tabs 70 and 71 to occupy positions of flat face contacting relation with the upper portion of main panel 41. Thereafter partition strips 74 and 75 are swung generally toward the left along fold lines 76 and 77 simultaneously with swinging movement of partition panel 80 generally toward the left. When the partition strips 74 and 75 occupy positions of approximately perpendicular relationship with respect to their associated anchoring tabs 70 and 75 and main panel 41, insert 35 appears as indicated in FIG. 1.

In order to form the partition insert 36, the same manipulative steps are performed which are employed in setting up the insert 35. The insert such as 35 is rotated approximately 180 degrees about a vertical axis and then appears as indicated at 36.

With the two inserts set up as described, the inserts are then lowered from above downwardly over the necks of the associated bottles. As shown, six bottles are disposed in rectilinear relation at each end of the carrier and after the inserts are lowered downwardly into separating position, the inserts and their associated bottles are loaded through opposite ends of the open-ended sleeve shown in FIG. 1.

This loading operation causes the partition panels 80 to move in face contacting relation with each other and by this means a double thickness separator partition is provided between the bottles of insert 35 and the adjacent bottles of insert 36.

Double thickness separation is provided between the bottles of one row such as B1, B2 and B3 by means of end tabs such as 47 and 53 which are folded into flat face contacting relation with their associated partition tabs 44 and 51. For example end tab 47 is swung over along fold lines 48 and 49 into flat face contacting relation with partition tab 44 and by this means a double thickness partition is provided. Similarly, end tabs 53, 61 and 66 are folded into flat face contacting relation with their associated partition tabs 51, 58 and 65. The three bottles associated with main panel 37 are separated from each other by double thickness partitions while the three bottles disposed alongside main panel 41 are separated by double partitions. These two rows of bottles are separated from each other by the main panels 37 and 41 which are disposed in flat face contacting relation with each other and by virtue of the spacer panel 38 and its associated serpentine fold lines 39 and 40 together with the fold lines 42 and 43 a plurality of pockets are formed such as are designated by the letters A, A', B, B', C and C' which are generally complementary to the exterior surface of the adjacent bottle and which thus afford cushioning between the bottles associated with panel 37 and those in the other row associated with main panel 41. Of course the end flaps and end panels of the tubular sleeve are closed and the carton is then complete.

As is apparent from FIG. 2, substantial economies of material are effected according to one aspect of the invention due to the fact that the end tab 47 of one blank such as is shown in FIG. 2 in effect is taken from a part of an adjacent blank because of the nesting relationship of end tab 47 with the edge 47*a* of an adjacent blank. Similarly tab 61 is nested in an adjacent blank as indicated at 61*a* while diagonal corner 70' of anchoring tab 70 coincides with diagonal line 70*a* of an adjacent blank. End 80' of partition panel 80 nests with edge 80*a* of an adjacent blank.

While the blank of FIG. 6 used to form the insert of FIG. 5 is not identical to the blank of FIG. 2, the same numerals have been used to designate the corresponding parts in FIG. 6 as were used in FIG. 2. It will be understood that FIG. 6 does not include anchoring panels 70 and 71 shown in FIG. 2. Instead partition strip 74-1 is interconnected with main panel 41 along fold line 76-1 which is angularly disposed with respect to an imaginary vertical line. Partition panel 80-1 is interconnected with partition strip 74-1 along fold line 78-1. In like fashion partition strip 75-1 is foldably joined to main panel 41 along angularly disposed fold line 77-1 and at the other end partition strip 75-1 is foldably joined to partition panel 80-1 along fold line 79-1 which fold lines are angularly disposed with respect to an imaginary vertical line. The blank of FIG. 6 is manipulated by folding main panel 41 upwardly along fold lines 42 and 43 to cause spacer panel 38 to assume a horizontal position with the main panels 37 and 41 disposed vertically and in face contacting relation with each other. Thereafter partition panel 80-1 is simply pushed to the left and outwardly away from its associated main panel 41 to cause partition strip 74-1 to swing along fold line 76-1 and to cause partition strip 75-1 to swing outwardly along fold line 77-1. Of course partition strips 74-1 and 75-1 fold into approximately normal relationship with partition panel 80-1. The angularly disposed fold lines 76-1, 77-1 and the associated fold lines 78-1 and 79-1 cause the panel 80-1 to move downwardly somewhat and to occupy the position shown in FIG. 5. The inserts as shown in FIG. 5 are inserted from opposite ends of the open ended tubular container shown in FIG. 1 in such manner that their partition panels 80-1 come into flat face contacting relationship with each other. The structure otherwise performs in a manner substantially identical to that described in connection with FIGS. 1–4 inclusive. It should be pointed out however that the side edges of partition strip 74-1 are specially configured as indicated at S1 and S2 to conform generally with the exterior of the adjacent packaged particles. Furthermore since the partition strip 74-1 and 75-1 are angularly disposed due to their fold lines 76-1 and 77-1, these partition strips form a substantial angularly disposed separator means between adjacent bottles in one row of bottles i.e. the row adjacent main panel 41.

The modification of the invention represented by the perspective view of the insert shown in FIG. 7 is formed from the blank of FIG. 8 and is substantially identical with the arrangements previously described in that main panels 37 and 41 are similar. The arrangement of FIGS. 7 and 8 however utilizes partition strips 74-2 and 75-2 in conjunction with a partition panel 80-2 which includes an elongated base portion 80-2*a* and an upstanding medial portion 80-2*b*. Partition strip 74-2 is foldably joined to the top edge of side wall 1 along fold line 76-2 and to the lower portion 80-2*a* of the partition panel along fold line 78-2. Similarly partition strip 75-3 is foldably joined to main panel 41 along fold line 77-2 and to the base portion 80-2*a* of the partition panel 80-2 along fold line 79-2. A medial fold line F1 is formed in partition strip 74-2 while a similar medial fold line F-2 is formed in partition strip 75-2. A medial fold line F-3 is formed in the base portion 80-2*a* and the upstanding portion 80-2*b* of the medial partition panel generally designated 80-2.

For the purpose of engaging underneath the outwardly extending flange portion of a bottle cap, a bracing panel 81 is cut from the blank and foldably joined to partition strip 74-2 along fold line 82. Similarly a bracing panel 83 is struck from the blank and foldably joined to partition strip 75-3 along fold line 84. As is apparent from FIG. 8, fold lines 82 and 84 are disposed on the sides of partition strips 74-2 and 75-2 respectively along the side edges thereof and adjacent main panel 41.

In order to set up the blank of FIG. 8 into the position depicted in FIG. 7, main panel 41 and all that portion of the blank which forms the lower portion of FIG. 8 are elevated and folded upwardly along fold lines 42 and 43 and along the serpentine side edges of spacer panel 38 to cause main panel 41 to occupy a position of flat face contacting relation with main panel 37. Thereafter panels 80-2*a* and 80-2*b* are pulled outwardly from main panel 41 to cause the structure to swing about fold lines 76-2 and 77-2 to cause the partition panels 74-2 and 75-2 to occupy the positions shown in FIG. 7 wherein medial fold lines F1 and F2 are uppermost with the fold lines 76-2 and 78-2 disposed at approximately the same level. Simultaneously bracing panel 81 is folded upwardly along fold line 82 and bracing panel 83 is folded upwardly along fold line 84 to occupy upper positions so that the edge portion E1 of bracing panel 81 is engaged below the outwardly extending flange of the adjacent bottle cap. Similarly the edge E2 of bracing panel 83 is arranged to engage the outwardly extending flange of an adjacent bottle cap. Similarly edge E3 of panel 80-2*b* is disposed to be received below the cap of a bottle such as B2 disposed between the bottles such as B1 and B3 which engage edges E1 and E2 respectively. Thus with the parts disposed as shown in FIG. 7, the insert is lowered downwardly about a group of six bottles arranged in two rows of three bottles each. Such an operation is performed at each of the open ends of the open ended sleeve shown in FIG. 1. Thereafter the two groups of bottles are loaded from opposite ends of the carrier to cause the medial panels 80-2*b* to engage each other while the elongated panels 80-2*a* engage each other.

Since the set-up insert shown in FIG. 9 and formed from the blank designated FIG. 10 is incorporated in all essential respects in all of the blanks described above, a detailed description of FIGS. 9 and 10 is not deemed necessary particularly since the same numerals are used in FIGS. 9 and 10 as are used in FIGS. 1–4 inclusive. Suffice it to say that main panel 41 of the blank of FIG. 10 is simply folded up into flat face contacting relation with the main panel 37 along fold lines 42 and 43 to cause the spacer panel 38 to assume a horizontal disposition. The partition tabs are manipulated as described in connection with FIG. 2 for example and the blank of FIGS. 9 and 10 thus forms the basic structure for a group of six articles arranged in two rows of three articles each. Of course the basic structure of FIGS. 9 and 10 makes no provision for use as one of a pair of structures so that the sleeve of FIG. 1 would necessarily be used in conjunction with only one insert such as is shown in FIG. 9. If need be, separate double thickness cross partitions could be employed to separate two separate inserts such as that shown in FIGS. 9 and 10, in which event a pair of inserts such as are shown in FIGS. 9 and 10 could be inserted from opposite ends of the open ended sleeve shown in FIG. 1 in a manner described above in detail in connection with FIGS. 1–4 inclusive.

In all of the arrangements described above, it may be desirable to form separator tabs in bottom panel 1 of the sleeve. If such is desirable, such tabs may be struck from bottom panel 1 and in FIG. 1 are designated at T1, T2, T3, and T4. An additional pair of inserts is not observable in FIG. 4 but of course would be employed should the arrangement be such that two pairs of inserts are employed and in which two rows of three bottles each are inserted from opposite ends of the carrier.

The embodiments of the invention in which an exclusive property or privilege is claimed are defined as follows:

1. A carrier partition insert for cushioning articles arranged in two rows of at least two articles each, said insert comprising a pair of vertically disposed main panels arranged for back-to-back disposition between the rows of articles, at least one partition tab foldably joined to each of said main panels, and a horizontally disposed spacer panel foldably joined along its side edges to the bottom edges of said main panels by serpentine fold lines to establish a spaced relation between the bottom portions of said main panels which defines article receiving cushioning pockets along the outer surface of each of said main panels.

2. An insert according to claim 1 wherein the side edges of said spacer panel of a configuration which is generally complementary to the adjacent surfaces of the associated articles.

3. An insert according to claim 1 wherein the side edges of said spacer panel are of configurations which are complementary to each other.

4. An insert according to claim 1 wherein a partition tab is struck from an end portion of each of said main panels.

5. A carrier partition insert for cushioning articles arranged in two rows of at least two articles each, said insert comprising a pair of vertically disposed main panels arranged for back-to-back disposition between the rows of articles, at least one anchoring tab foldably joined to the top edge of one of said main panels, and a partition strip foldably joined at one end thereof to said anchoring tab and at the other end to a partition panel, said anchoring tab being disposed in flat face contacting relation to said one main panel.

6. An insert according to claim 1 wherein at least one partition strip is foldably joined at one end thereof to one of said main panels along a base fold line which is disposed at an angle to an imaginary vertical line and which is foldably joined at the other end thereof to a partition panel along a fold line which is disposed at an angle corresponding to the angular disposition of said base fold line.

7. An insert according to claim 6 wherein said partition strip is formed with recessed side edges.

8. An insert according to claim 7 wherein said recessed side edges of said partition strip are configured so as to coincide approximately with the exterior of adjacent articles.

9. A carrier partition insert for cushioning articles arranged in two rows of at least two articles each, said insert comprising a pair of vertically disposed main panels arranged for back-to-back disposition between the rows of articles, at least one partition strip foldably joined at one end thereof to one of said main panels along a base fold line which is disposed at an angle to an imaginary vertical line and which is foldably joined at the other end thereof to a partition panel along a fold line which is disposed at an angle corresponding to the angular disposition of said base fold line, said partition strip being formed with recessed side edges.

10. An insert according to claim 1 wherein at least one partition strip is foldably joined at one end thereof to one of said main panels and at the other end thereof to a partition panel and wherein a bracing panel is foldably joined to said partition strip along a side edge thereof and at the end thereof adjacent said one main panel.

11. An insert according to claim 10 wherein a fold line is formed in said partition strip and disposed transversely therein and approximately midway between the ends thereof.

12. An insert according to claim 10 wherein said partition panel includes an elongated base portion and an upstanding medial bracing portion.

13. A carrier partition insert for cushioning articles arranged in two rows of at least two articles each, said insert comprising a pair of vertically disposed main panels arranged for back-to-back disposition between the rows of articles, at least one partition strip foldably joined at one end thereof to one of said main panels and at the other end thereof to a partition panel, said partition panel including an elongated base portion and an upstanding medial bracing portion and wherein a bracing panel is foldably joined to said partition strip along a side edge thereof and at the end thereof adjacent said one main panel.

14. An insert according to claim 5 wherein a horizontally disposed spacer panel is foldably joined along its side edges to the bottom edges of said main panels by serpentine fold lines to establish a spaced relation between the bottom portions of said main panels which defines article receiving cushioning pockets along the outer surface of each of said main panels.

15. An insert according to claim 14 wherein the side edges of said spacer panel are of a configuration which is generally complimentary to the adjacent surfaces of the associated articles, 16. An insert according to claim 5 wherein the side edges of said panel are of configurations which are complimentary to each other.

17. An insert according to claim 5 wherein a partition tab is struck from an end portion of each of said main panels.

18. An insert according to claim 5 wherein end tabs are foldably joined to the ends of said partition tabs respectively are folded into flat face contacting relation therewith so as to form two ply separation between adjacent articles.

19. A carrier partition insert for cushioning articles arranged in two rows of at least two articles each, said insert comprising a pair of vertically disposed main panels arranged for back-to-back disposition between the rows of articles, at least one partition tab foldably joined to each of said main panels, a horizontally disposed spacer panel foldably joined along its side edges to the bottom edges of said main panels by serpentine fold lines to establish a spaced relation between the bottom portions of said main panels which defines article receiving cushioning pockets along the outer surface of each of said main panels, and end tabs foldably joined to the ends of said partition tabs respectively and folded into flat face contacting relation therewith so as to form a two-ply separation between adjacent articles.

20. A carrier partition insert for cushioning articles arranged in two rows of at least two articles each, said insert comprising a pair of vertically disposed main panels arranged for back-to-back disposition between the rows of articles, at least one partition tab foldably joined to each of said main panels, a horizontally disposed spacer panel foldably joined along its side edges to the bottom edges of said main panels by serpentine fold lines to establish a spaced relation between the bottom portions of said main panels which defines article receiving cushioning pockets along the outer surface of each of said main panels, at least one anchoring tab foldably joined to the top edge of one of said main panels, and a partition strip foldably joined at one end thereof to said anchoring tab and at the other end to a partition panel.

21. An insert according to claim 20 wherein said anchoring tab is disposed in flat face contacting relation to said one main panel.

* * * * *